US005113307A

United States Patent [19]

Meyer et al.

[11] Patent Number: 5,113,307

[45] Date of Patent: May 12, 1992

[54] CURRENT CONTROLLED SOLENOID DRIVER

[75] Inventors: Herbert Meyer; Zoltan Giday, both of Neumünster; Thomas Balow, Brokstedt, all of Fed. Rep. of Germany

[73] Assignee: Licentia Patent-Verwaltungs-GmbH, Frankfurt, Fed. Rep. of Germany

[21] Appl. No.: 487,897

[22] Filed: Mar. 6, 1990

[30] Foreign Application Priority Data

Mar. 14, 1989 [DE] Fed. Rep. of Germany ..... 3908192

[51] Int. Cl.[5] ..... H01H 47/32; H01H 47/22

[52] U.S. Cl. ..... 361/154; 361/152

[58] Field of Search ..... 323/284, 285, 154, 299; 361/160, 170, 187, 152, 139, 153, 154

[56] References Cited

U.S. PATENT DOCUMENTS

| | | | |
|---|---|---|---|
| 4,327,394 | 4/1982 | Harper | 361/154 |
| 4,453,194 | 6/1984 | Frankeny et al. | 361/154 |
| 4,453,652 | 6/1984 | Merkei et al. | 361/154 |
| 4,661,766 | 4/1987 | Hoffman et al. | 323/287 |
| 4,667,117 | 5/1987 | Nebgen et al. | 361/152 |

OTHER PUBLICATIONS

Data Book L5832, SGS, Jan. 1987, (pp. 554–567).

Preliminary Data Sheet No. PD-9.454, "HEXSense-Current Sense IRC530 C Series Power MOSFET IRC533", International Rectifier (8 pages).

*Primary Examiner*—Steven L. Stephan
*Assistant Examiner*—B. Davidson
*Attorney, Agent, or Firm*—Spencer & Frank

[57] ABSTRACT

An electronic contactor controller circuit able to handle high currents and voltages includes an integrated circuit power circuit switch which provides a measuring output signal representative of the load current to an operational amplifier current to voltage convertor. The output voltage of the operational amplifier is provided to an input of a comparator, and at least one reference voltage, from reference voltage generating circuitry, is provided to the other input of the comparator. The comparator outputs a signal to control a timer circuit, which in turn controls the current switch.

1 Claim, 3 Drawing Sheets

CURRENT CONTROLLED SOLENOID DRIVER

BACKGROUND OF THE INVENTION

The invention relates to an electronic contactor controller for regulating the direct current feed in a circuit with a fluctuating supply voltage, and for a variety of driving coil winding resistances, by means of current switching and having a free-running circuit for holding the contactor during current turn-off phases.

The use of special IC's (integrated circuits) is known for the actuation of electromagnetic actuators employed, for example, as striking magnets in daisy wheel printers, as solenoid, or in magnetic valves. Such a special IC is, for example, the controller module L5832 made by SGS which is described in their "Data Book" published in Jan. 1987. The module permits clocked current regulation of the turn-on current of actuators, with the driver output of the module being employed to actuate the base of a Darlington transistor which serves as the setting device in the current control circuit. The actual value of the turn-on current is detected by a low-ohmic measuring resistor whose measuring input is limited to a voltage signal of 450 mV. At the end of an adjustable turn-on current duration, the module switches the operating current to a holding current which, in contrast to the turn-on current, is not regulated. The turn-on current clock of the module is started only when the operating current has exceeded the predetermined turn-on current value.

U.S. Pat. No. 4,453,194 discloses an integrated bipolar circuit in which a fraction of the total current is branched off for a current measurement and is connected by way of a measuring transistor with a current-/voltage converter. The correspondingly generated signal of the current/voltage converter controls the circuit employed to regulate the current. The bipolar technology has the drawback of a limited operating voltage which is not sufficient for orders of magnitude customary in low-voltage networks.

SUMMARY OF THE INVENTION

It is an object of the invention present to create an actuator that is able to handle high currents and voltages, and to ensure low-loss and accurate current measurements the actual value in the control circuit, as well as provide a defined, operationally reliable, turn-on current.

This is accomplished by one embodiment of the invention.

The invention has the advantage that larger currents can be regulated than with the L5832 controller module since the measuring input of this module limits the turn-on current to $I_P=0.45/R_S$. Since measuring resistors operating with a lower value than 0.1 Ω cannot be employed with justifiable expense, the maximum current that can be regulated with the module is limited to about 4 A. In addition to greater current carrying capability, the present invention has the further advantage that an expensive low-ohmic measuring resistor is not required which, in addition to being more expensive, is also involved in a difficult delivery situation and thus may pose problems in manufacture.

In another embodiment of the present invention, the regulation of the turn-on and turn-off current improves the efficiency of the contactor in a advantageous manner. Moreover, starting the clock independently of the magnitude of the turn-on current increases the reliability of the contactor actuator. That is to say, the conventional L5832 controller module starts the turn-on current clock-only after, the turn-on current has reached its predetermined value. Should the predetermined turn-on current not be reached, the module would not switch to holding current and the semiconductor components would become thermally destroyed by the continuous high current. Another advantage accordingly to the present invention lies in the use of a threshold switch controlled by the input voltage at the input of the contactor actuator which prevents fluttering of the contactor due to undefined turn-on levels and turn-off.

BRIEF DESCRIPTION OF THE DRAWINGS

One embodiment of the invention will now be described in greater detail with reference to the drawings in which.

DETAILED DESCRIPTION OF THE PREFERRED EMBODIMENT(S)

Figure 1:
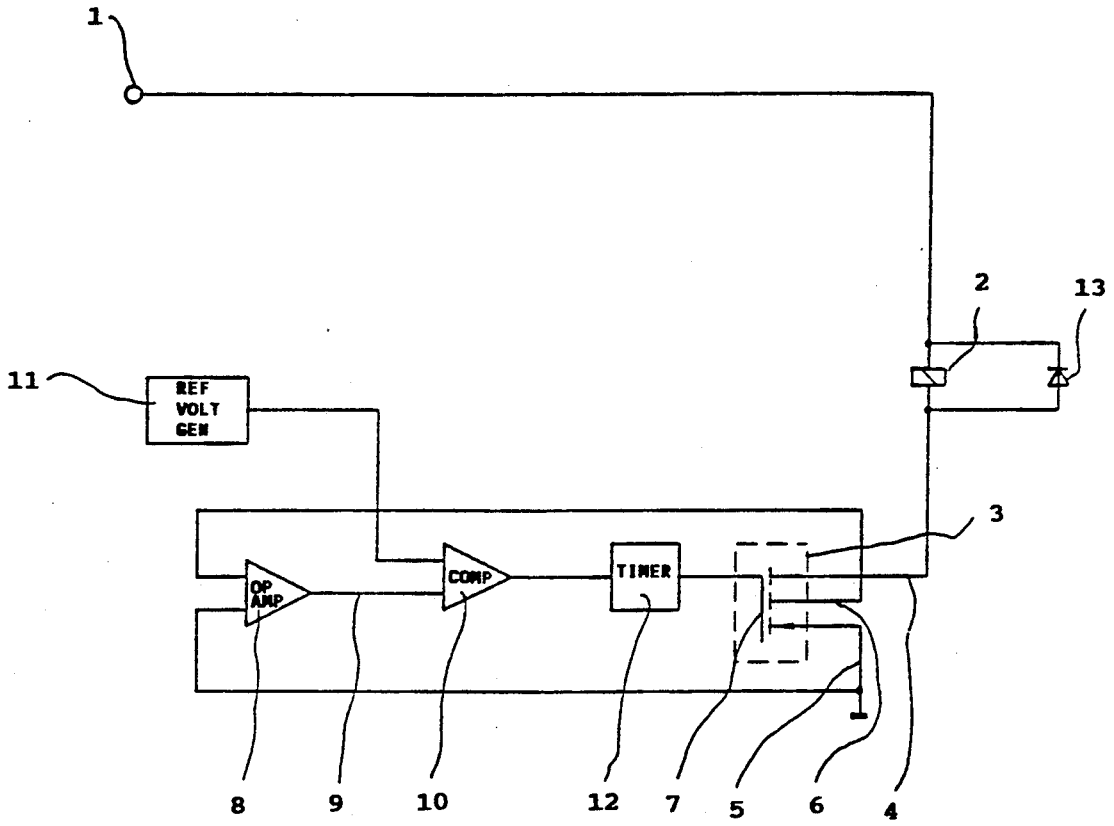
FIG. 1 is an electronic contactor actuator including a power FET (field effect transistor)
Figure 3:
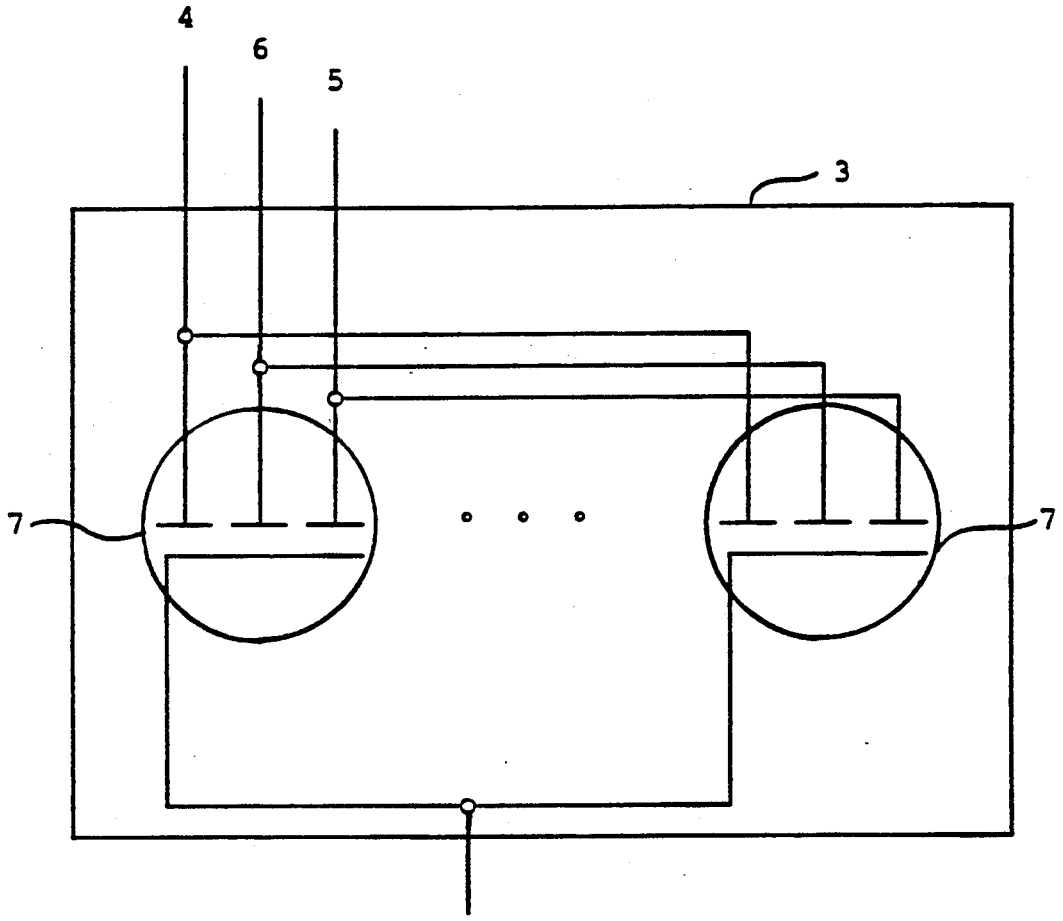
FIG. 3 is a schematic diagram of the power FET of FIG. 2.

An electronic contactor actuator according to one embodiment of the present invention shown in FIG. 1 for controlling a direct current contactor is charged with a supply voltage at its input terminal 1. The current through contactor coil 2 is switched by means of an integrated power semiconductor circuit current switch 3 for the purpose of regulating the current. In order for the contactor not to drop off during the off-phases of the timing process, a known free-running circuit including a diode 13 for direct current contactors is provided. The control of the current requires a measurement of the current flowing through the contactor coil. This is done at the measuring output 6 of the integrated power semiconductor circuit current switch 3. A HEXSense module made by International Rectifier is employed as circuit 3, (see FIG. 3). In this module, approximately 1600 MOSFET's are 7 connected in parallel, and the current is divided uniformly among the individual MOSFET's 7. Measuring terminal 6, at the source terminal of one MOSFET's 7, leads toward the outside of the circuit 3. Approximately one sixteen-hundredth of the total current is measured at this terminal 6. The precise ratio of the number of MOSFET's 7 to the measuring MOSFET is indicated by the manufacturer by way of a scale factor associated with the respective module. By means of an operational amplifier 8, the current at measuring output 6 is converted to a voltage which is fed to the negative input 9 of a comparator 10. The positive input of this comparator 10 receives the output signal of a reference voltage generator 11. If the actual voltage for the contactor current is greater than the reference voltage, the output of the comparator flips from a positive voltage value to zero (00) and thus starts the turn-off timer 12 which controls the turn-off phases of the current switch 3.

Figure 2:
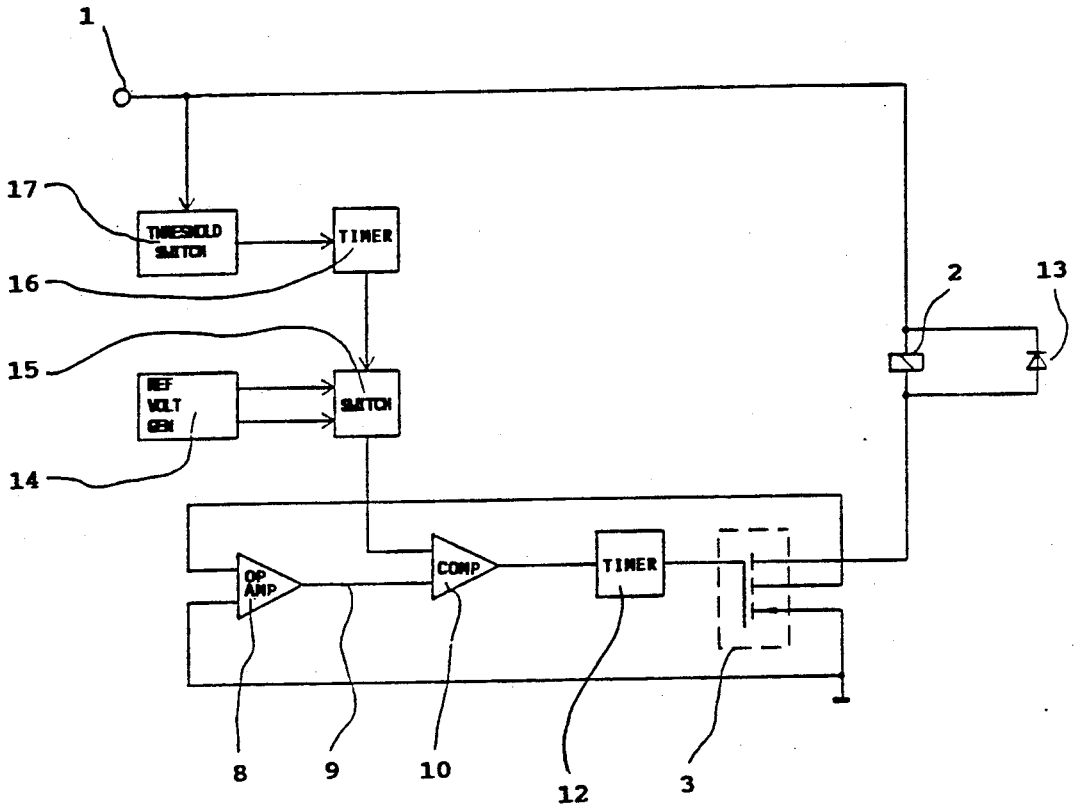
FIG. 2 is a contactor actuator for two rated current values including a switch, a timer and a threshold switch.

FIG. 2 shows a contactor actuator according to another embodiment of the present invention with which the turn-on current, as well as the holding current, of a contactor are regulated. For this purpose, two different reference voltages are made available by a reference voltage generator 14: a reference voltage of a higher voltage value for the short-term turn-on current, and a reference voltage of a lower voltage value for the holding current of the contactor. The switching between the reference voltage values is effected by means of an electronic switch 15 which is controlled by an electronic timer 16 to successively switch the reference voltages to comparator 10. As soon as the supply voltage is at input terminal 1 present, timer 16 starts the turn-on current phase. The presence of the supply voltage is monitored by means of an electronic threshold switch 17 which is disposed at the input terminals 1 of the contactor actuator. If the supply voltage has not exceeded a fixed turn-on threshold, timer 16 is prevented from starting. Thus no reference signal is present at the comparator and 10 the drain-source path of the integrated semiconductor circuit current switch 3 is blocked so that no current flows through contactor coil 2. Threshold switch 17 also monitors the turn-off process of the contactor actuator. If the supply voltage drops to below a fixed turn-off threshold, no reference voltage is present at comparator 10 and integrated semiconductor circuit current switch 3 is blocked. Thus, threshold switch 17 causes defined turning on and off of the contactor, and thereby prevents fluttering of the contactor.

We claim:

1. In an electronic contactor controller for regulating the direct current feed in a circuit with a fluctuating supply voltage, and handling a variety of different driving coil winding resistances or loads, by means of current switching, and having a free-running circuit connected to the coil for holding the contactor during the current turn-off phases, a control circuit comprising:

(a) a power circuit means for switching current through a load, formed as an integrated power semiconductor circuit which includes a plurality of parallel connected FET's of which at least one serves to provide a measuring output signal for indicating load current;

(b) an operation al amplifier current to voltage converting means, operatively connected to receive said measuring output signal, for converting said measuring output signal into a first voltage output signal;

(c) reference voltage providing means for providing at least one reference voltage output signal;

(d) comparator means, operatively connected to receive said first voltage output signal and said at least one reference output voltage signal, for providing a first control signal as an output indicative of a comparison of said first and said at least one reference voltage output signals;

(e) first timer means responsive to said first control signal for controlling the turning on and off said power circuit means; and wherein said reference voltage providing means comprises:

(1) dual reference voltage generator means for producing at least two reference voltage levels;

(2) threshold switch means, connected to monitor a source voltage signal, for producing a second control signal indicative of whether the source voltage has reached a certain threshold level;

(3) second timer means, connected to receive said second control signal from said threshold switch means, for outputting, responsive to said second control signal, a third control signal; and (4) voltage switching means, connected to receive said third control signal, for switching, responsive to said third control signal, said at least one reference output voltage signal between said at least two reference voltage levels, a first of the voltage levels being for controlling a short-term turn-on current of the load, and a second of the voltage levels being for controlling a holding current of the load.

* * * * *